US007857537B2

(12) United States Patent
Busam et al.

(10) Patent No.: US 7,857,537 B2
(45) Date of Patent: Dec. 28, 2010

(54) WRITING INSTRUMENT PACKAGING

(75) Inventors: Edward P. Busam, Mason, OH (US); Kevin W. Witter, Dayton, OH (US)

(73) Assignee: MeadWestvaco Corporation, Richmond, VA (US)

( * ) Notice: Subject to any disclaimer, the term of this patent is extended or adjusted under 35 U.S.C. 154(b) by 1090 days.

(21) Appl. No.: 11/294,511

(22) Filed: Dec. 5, 2005

(65) Prior Publication Data

US 2007/0127979 A1 Jun. 7, 2007

(51) Int. Cl.
*B43K 29/00* (2006.01)

(52) U.S. Cl. ..... 401/195; 401/131

(58) Field of Classification Search ..... 401/52, 401/131, 195; 281/22, 45; 206/232; 402/4
See application file for complete search history.

(56) References Cited

U.S. PATENT DOCUMENTS

| | | | | |
|---|---|---|---|---|
| 2,606,041 | A * | 8/1952 | Misiak, Jr. | 281/30 |
| 3,638,783 | A | 2/1972 | Enseki et al. | |
| 3,968,546 | A | 7/1976 | Seaborn et al. | |
| 4,261,466 | A | 4/1981 | Wilford | |
| 4,838,724 | A | 6/1989 | Spence, Jr. | |
| 5,186,320 | A | 2/1993 | Aida | |
| 5,505,301 | A | 4/1996 | Foley | |
| 5,823,574 | A * | 10/1998 | Sullins et al. | 281/45 |
| 6,029,816 | A | 2/2000 | Goodwin et al. | |
| 6,106,014 | A * | 8/2000 | Werner et al. | 281/22 |
| 6,196,388 | B1 | 3/2001 | Kaposvari | |
| 6,315,119 | B1 | 11/2001 | Lee | |
| D451,273 | S | 12/2001 | Moor et al. | |
| 6,382,864 | B1 | 5/2002 | Moor | |
| 6,543,615 | B2 | 4/2003 | Lake | |
| 6,612,771 | B1 | 9/2003 | Su | |
| 0,136,774 | A1 | 7/2004 | O'Boyle | |

FOREIGN PATENT DOCUMENTS

| | | |
|---|---|---|
| DE | 19605237 | 8/1997 |
| GB | 2263666 | 8/1993 |
| NL | 1013227 | 4/2001 |
| WO | 98/34510 | 8/1998 |

* cited by examiner

*Primary Examiner*—Huyen Le
(74) *Attorney, Agent, or Firm*—MWV Intellectual Property Group

(57) ABSTRACT

A writing instrument system including a writing instrument and packaging generally encasing the writing instrument, wherein the packaging includes an opening formed therein. The system further includes a retaining component, configured to be releasably coupled to the writing instrument. The retaining component is configured to at least partially extend through the opening when the writing instrument is releasably coupled to the retaining component.

28 Claims, 8 Drawing Sheets

WRITING INSTRUMENT PACKAGING

The present invention is directed to a packaging system for a writing instrument, and particularly, to a packaging system for a writing instrument which allows the writing instrument to be removably coupled to a retaining component.

BACKGROUND

Writing instruments, such as pens, pencils, markers, crayons, highlighters and the like are often packaged for sale to a flat panel or bound component, such as a journal, diary, date book, address book, notebook, binder, or the like. For example, the writing instrument may be sold with the bound component as a notebook/writing instrument system. It may be desired to securely package the writing instrument to the bound component to prevent the writing component from being separated from the bound component, and to prevent theft of the writing instrument. However, many existing packaging systems do not allow the user to sufficiently inspect the writing instrument, which can be an important part of the purchasing decision.

Accordingly, there is a need for a writing instrument packaging system which allows inspection and/or manipulation of the writing instrument.

SUMMARY

In one embodiment, the present invention is a writing instrument packaging system which allows inspection and/or manipulation of the writing instrument. In particular, in one embodiment the invention is a writing instrument system including a writing instrument and packaging generally encasing the writing instrument, wherein the packaging includes an opening formed therein. The system further includes a retaining component configured to be releasably coupled to the writing instrument. The retaining component is configured to at least partially extend through the opening when the writing instrument is releasably coupled to the retaining component.

In another embodiment the invention is a writing instrument system including a writing instrument and a spring clip having base portion and a pair of arms defining an opening therebetween. The spring clip and the writing instrument are configured such that the writing instrument is releasably received in the opening to retain the writing instrument therein. The system further includes coupling component coupling the writing instrument and the spring clip. The writing instrument is movable between a coupled position wherein the writing instrument is removably received in the spring clip, and an uncoupled position wherein the writing instrument is not received in the spring clip. The coupling component couples the writing instrument and the spring clip when the writing instrument is in the coupled position and when the writing instrument is in the uncoupled position.

DETAILED DESCRIPTION

Figure 1:
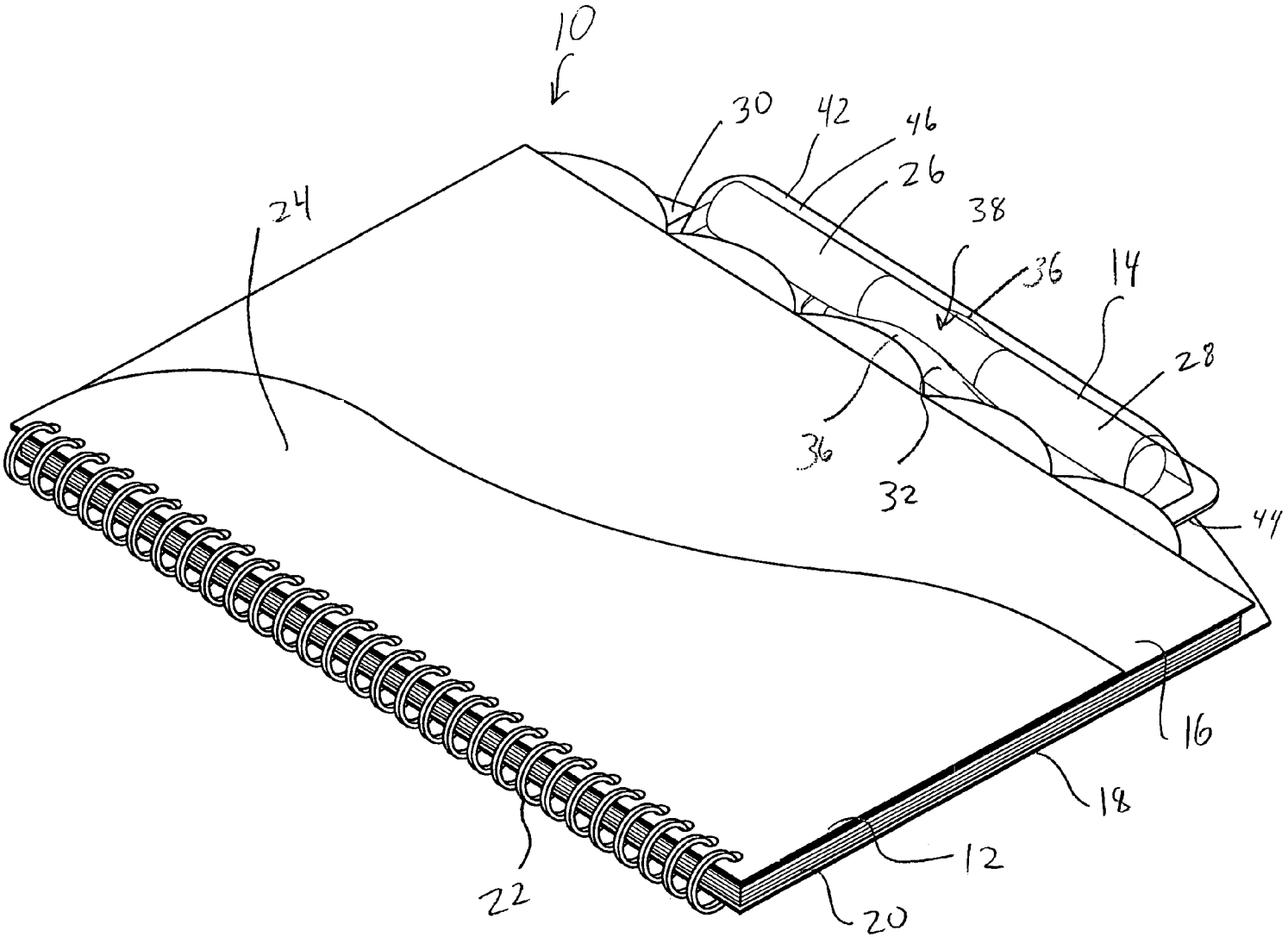
FIG. 1 is a front perspective view of one embodiment of the writing instrument system of the present invention, with the cover flap in a closed position.
Figure 2:
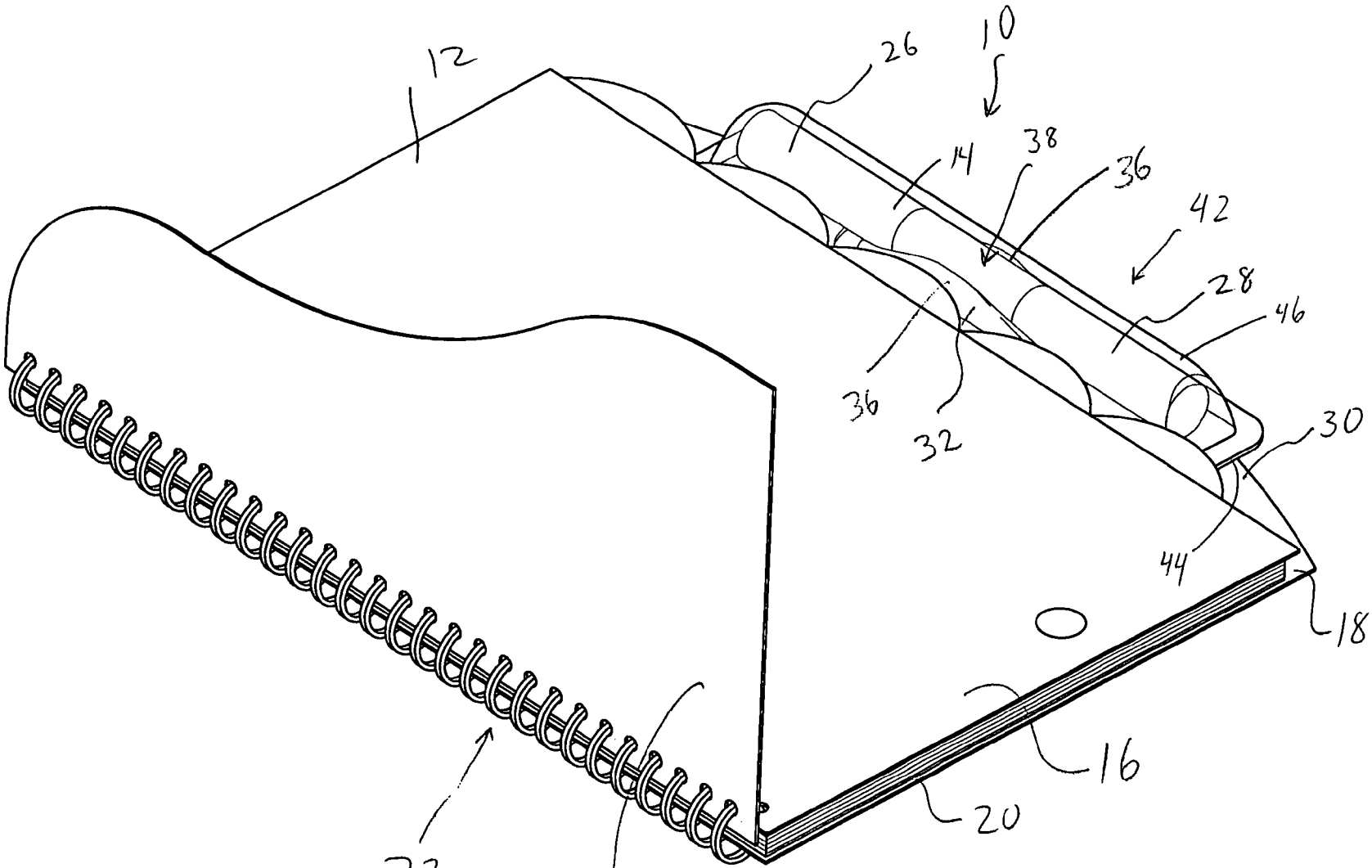
FIG. 2 is a front perspective view of the writing instrument system of FIG. 1, with the cover flap partially open.

As shown in FIG. 1, the writing instrument system 10 may include a bound component 12 and a writing instrument 14 coupled thereto. The bound component 12 may take the form of a journal, diary, date book, address book, notebook, binder, or the like. In the illustrated embodiment the bound component 12 includes a front cover 16, a rear cover or backing panel 18, and a plurality of pages 20 bound to the front 16 and rear 18 covers by a binding mechanism 22. As shown in FIG. 2, the front cover 16 may include a cover flap 24 located thereon and pivotally mounted to the binding mechanism 22.

Each of the pages 20 may be made of a cellulose-based paper or pulp-based paper such that the pages 20 can be written upon by a wide variety of media. Each of the front 16 and rear 18 covers may be made of material having at least one of a stiffness or thickness greater than the pages 20, and can be made of, for example, cardboard, paperboard, plastic, etc.

In the illustrated embodiment, the writing instrument 14 includes writing or dispensing tips at opposite ends of the writing instrument, with each tip having a removable end cap 26, 28. For example, one writing tip of the writing instrument 14 may dispense permanent solvent-based markings, and the other writing tip of the writing instrument 14 may dispense an erasing solution to allow the permanent marking to be erased. However, the writing instrument 14 may include only a single writing/dispensing tip, and may have only a single cap located thereon.

Figure 3:
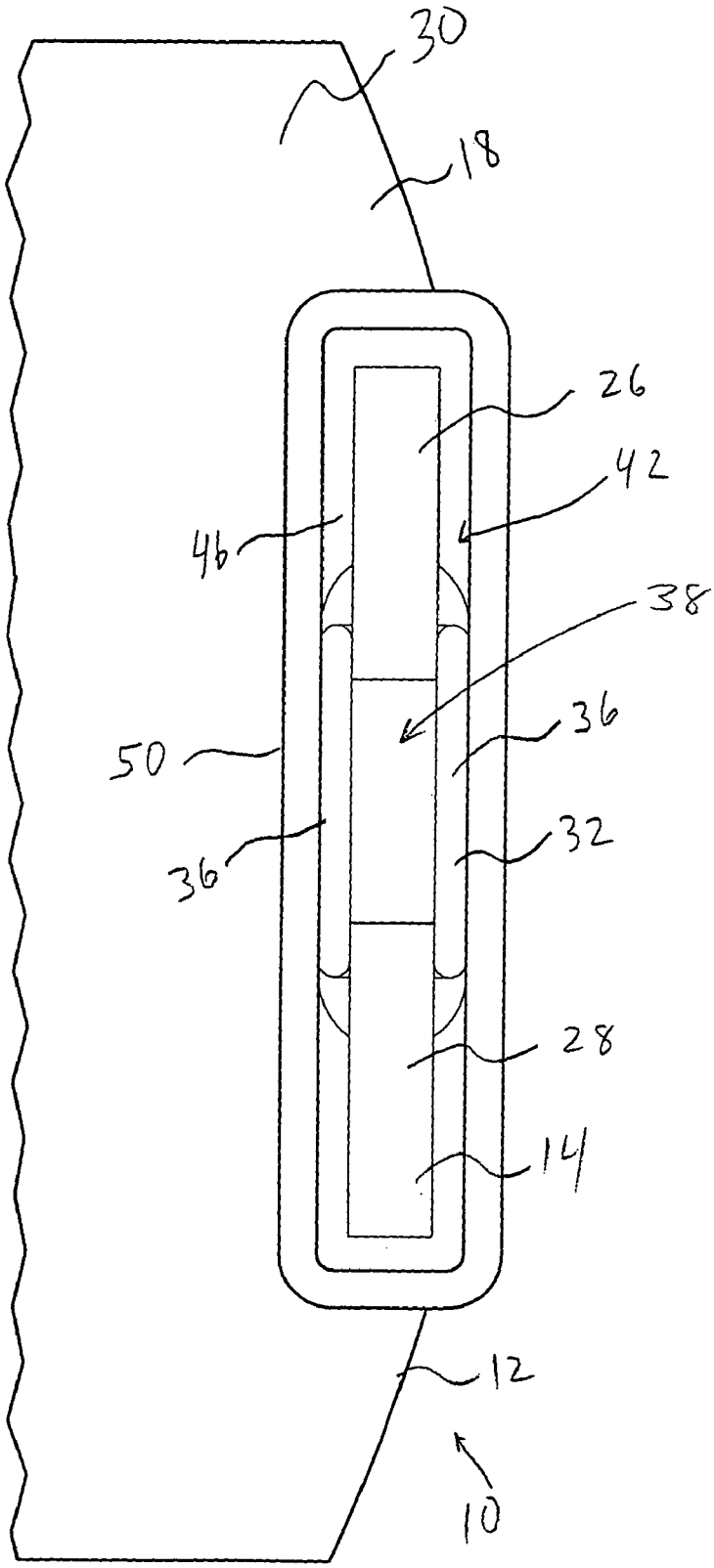
FIG. 3 is a top view of the writing instrument and part of the bound component of FIG. 1.
Figure 4:
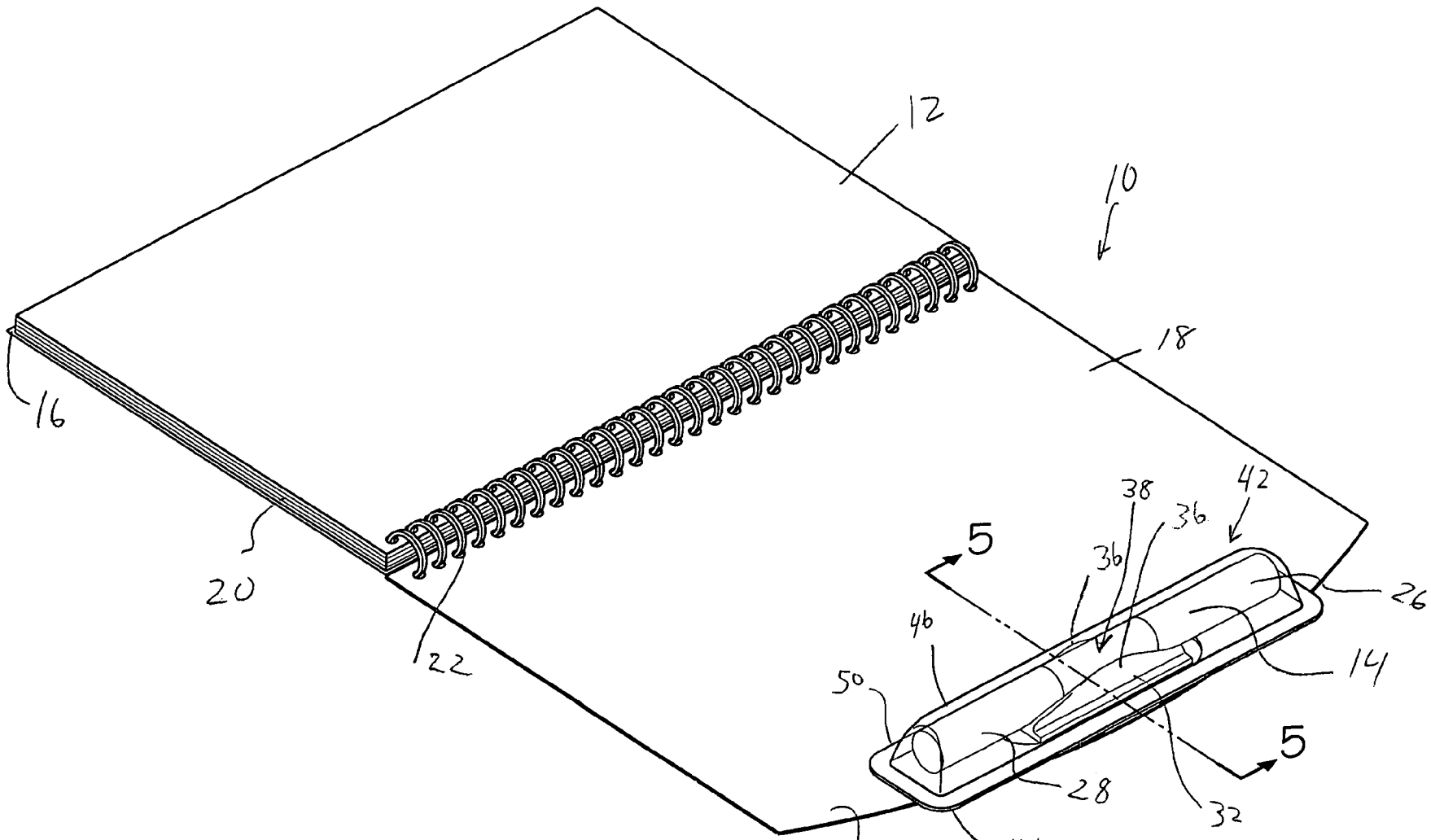
FIG. 4 is a front perspective view of the writing instrument system of FIG. 1, with the bound component opened to the back cover.

As can be best seen in FIGS. 1-3, one of the covers 16, 18 (i.e., the rear cover 18 in the illustrated embodiment) may have a surface area greater than the other cover 16 and/or the plurality of pages 20. In particular, the rear cover 18 may include a protruding portion 30 which is not covered by the pages 20 and/or front cover 16 when the bound component 12 is in its closed position. In the illustrated embodiment, the protruding portion 30 is shaped as a circle segment with a curved outer edge although the protruding portion 30 can take a wide variety of other shapes and/or forms. In the illustrated embodiment, the writing instrument 14 is coupled to the protruding portion 30 to ensure that the writing instrument 14 is always viewable and accessible even when the bound component 12 is closed.

Figure 6:
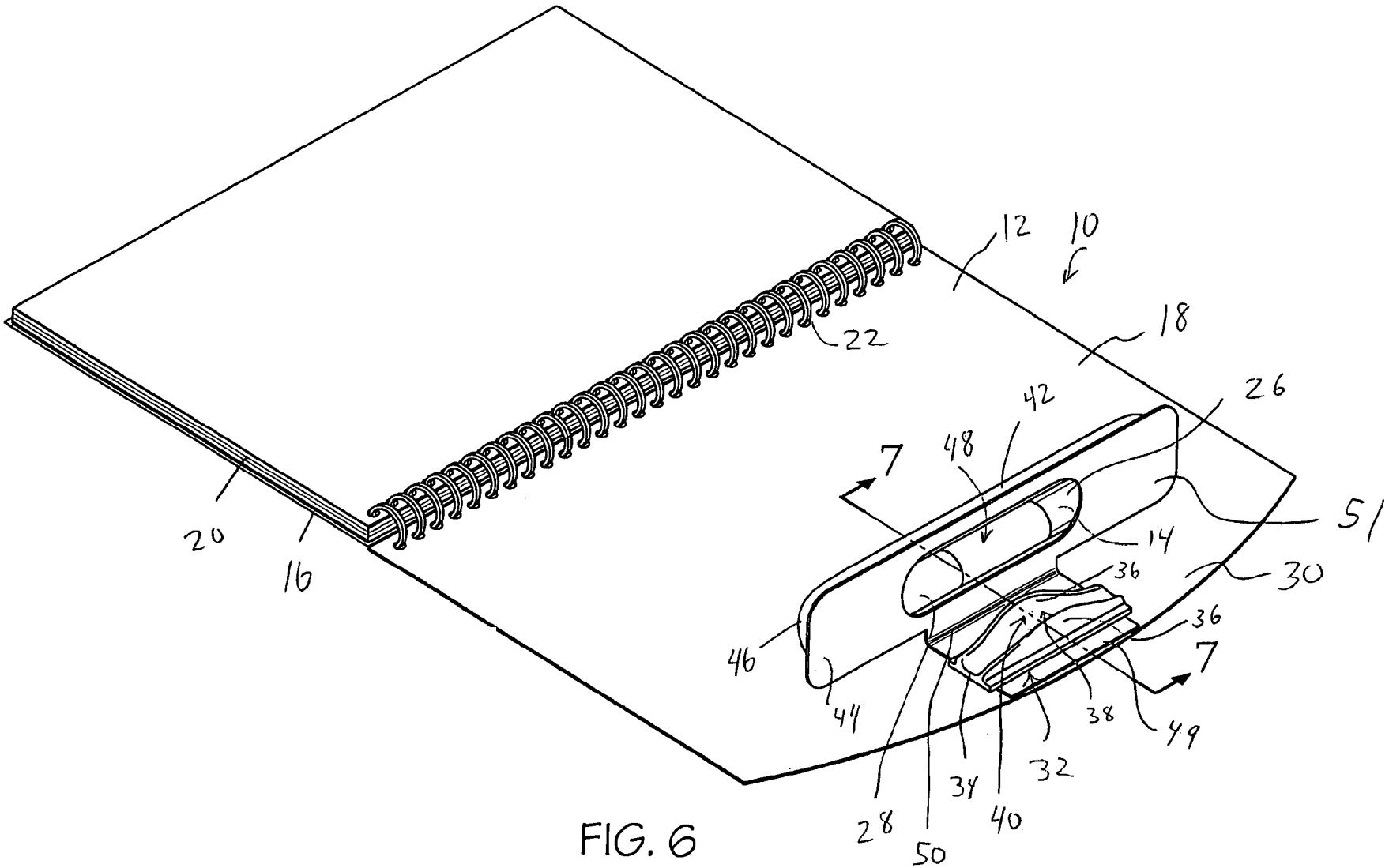
FIG. 6 is a front perspective view of the writing instrument system of FIG. 5, with the writing instrument packaging pivoted to an open position.
Figure 7:
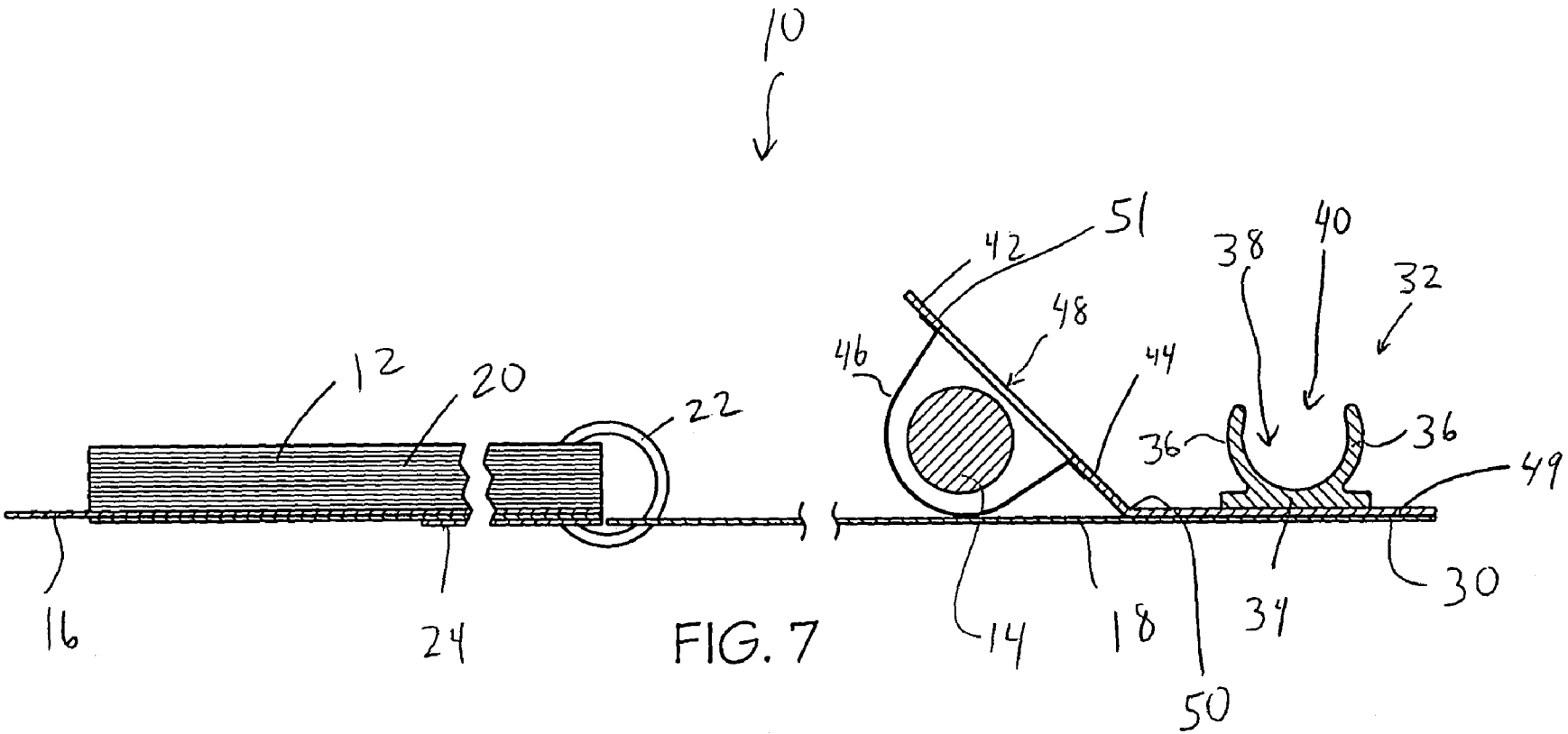
FIG. 7 is a side cross section taken along line 7-7 of FIG. 6.
Figure 8:
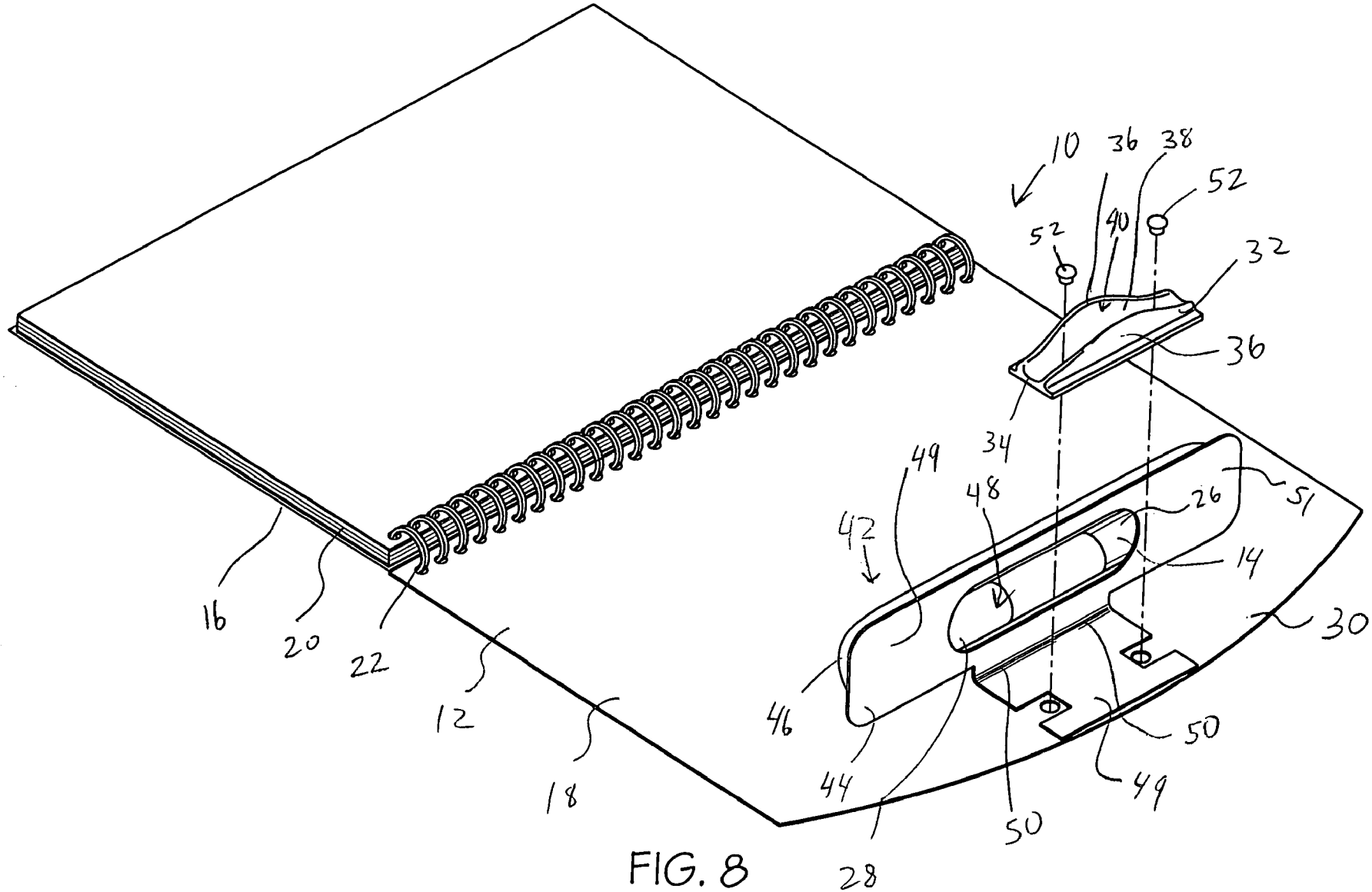
FIG. 8 is an exploded view of the writing instrument system of FIG. 6.

As best shown in FIGS. 6-8, a retaining component 32, in the form of a spring clip in one embodiment, may be located on or coupled to the protruding portion 30. In the illustrated embodiment, the spring clip 32 is generally "U"-shaped in end view or cross section, and includes a base portion 34 and a pair of contoured arms 36 extending upwardly away from the base 34. The arms 36 define an opening 38 therebetween with the opening 38 having a mouth 40 located between the distal ends of the arms 36, or at the narrowest space between the arms 36.

The mouth 40 may have a width which is smaller than the width of a portion of the writing instrument 14 to be received in the spring clip 32. In order to couple the writing instrument 14 to the spring clip 32, the writing instrument 14 is pressed into and through the mouth 40 until the writing instrument 14 is fully seated in the opening 38. The arms 36 have sufficient flexibility to flex or spring outwardly while the writing instrument 14 is manually pressed into the opening 38. The writing instrument 14 can then be manually removed by pulling the writing instrument 14 away from the spring clip 32 and through the mouth 40, which again flexes the arms 36 outwardly.

The system 10 may include packaging or a coupling component 42. In one embodiment, the packaging 42 generally encases the writing instrument 14. In particular, the packaging 42 may include a lower portion 44 which is generally flat or sheet-like and can be made of cardboard, paperboard, plastic or the like. The packaging 42 may also include an upper portion 46 coupled to the lower portion 44 and closely receiving the writing instrument therein. The upper portion 46 can be made of a generally transparent or translucent plastic material (such as a blister-type material). However, the upper portion 46 can be made of a variety of materials such as cardboard, paperboard, opaque plastic, etc. As best shown in FIGS. 6 and 8, the lower portion 44 may include an opening 48 formed therein.

In the illustrated embodiment, the lower portion 44 includes a hinge or crease line or crease area 50 formed therein, and is coupled to the spring clip 32 and/or rear cover 18. In particular, as best shown in FIG. 8, the lower portion 44 may include an extension portion 49 located to the right of the hinge line 50. A pair of rivets 52 may extend through the spring clip 32 and the rear cover 18, and adjacent to the extension portion 49 to trap the packaging 42 between the spring clip 32 and the rear cover 18. In this manner, at least part of the packaging 42 is positioned between the rear cover 18 and the spring clip 32.

The writing instrument 14 and/or distal end of the packaging 42 may be pivotable about the hinge 50. In particular, the writing instrument 14 and distal end of the packaging 42 may be pivotable between a coupled position (FIG. 1-5) wherein the writing instrument 14 is directly coupled to the spring clip 32 and an uncoupled position (FIGS. 6 and 7) wherein the writing instrument 14 is not directly coupled to the spring clip 32.

Figure 5:
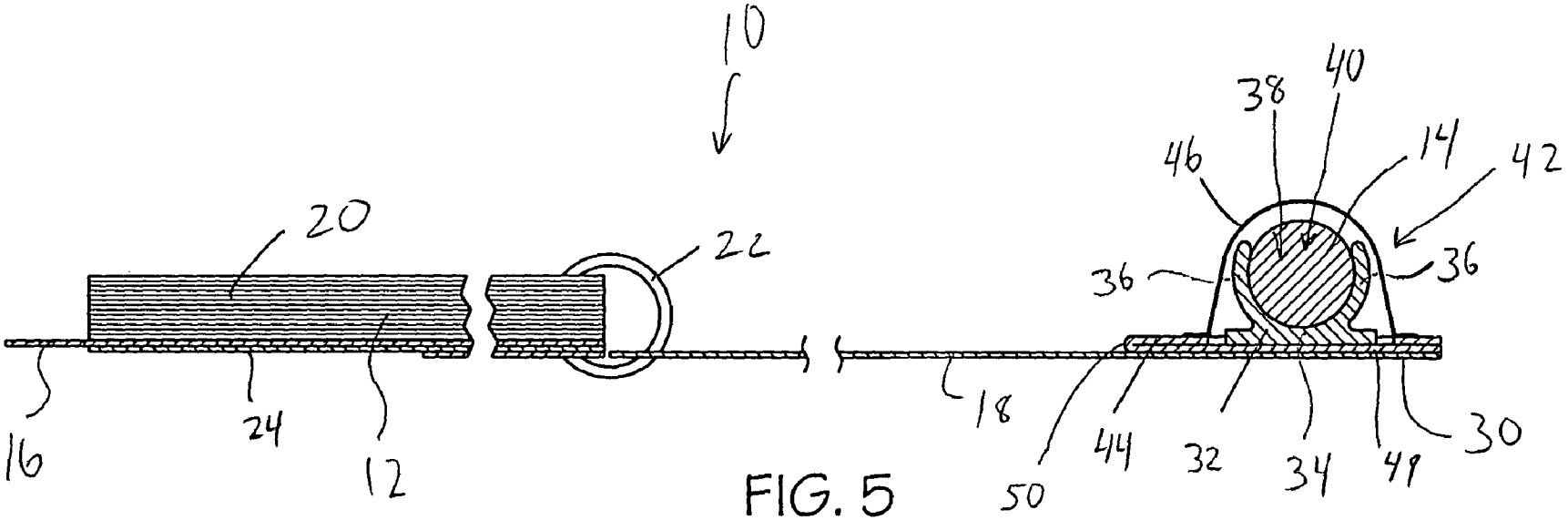
FIG. 5 is a side cross section taken along line 5-5 of FIG. 4.

The opening 48 is sized to receive the spring clip 32 therein when the writing instrument 14 is in its coupled position. In the illustrated embodiment, the size and shape of the opening 48 generally corresponds to the footprint of the spring clip 32 (i.e., the size and shape of the spring clip 32 in top view) or may be slightly larger such that the opening 48 can closely receive the spring clip 32 therein. The lower portion 44 may form or include a generally flat bottom surface 51 which is configured to lay flat against the rear cover 18/extension portion 49 when the writing instrument 14 is in the coupled position. The packaging/coupling component 42 may be generally flexible such that the packaging 42 is bent (i.e., about hinge line 50) when the writing instrument 14 is in the coupled position, as shown in FIG. 5. In addition, rather than having a clearly defined hinge, the bottom portion 44 may be made of a flexible or elastic material that can easily bend and does not include a defined hinge line.

In this manner, the writing instrument 14 is pivotable or movable between the coupled and uncoupled positions. This mounting arrangement allows a user to inspect the spring clip 32 to view the writing instrument 14 and the manner in which the writing instrument 14 is coupled to the bound component 12. In addition, a user can reach through and feel the writing instrument 14 through the opening 48, and can view the writing instrument 14 through top portion 46 of the packaging 42. Thus, the mounting system allows the user great ability and access to view and even feel the writing instrument 14. However, because the writing instrument 14 remains securely packaged within the packaging 42, the writing instrument 14 is not easily removed and remains secure. In addition, because the packaging 42 covers the distal ends of the writing instrument 14, the end caps 26, 28 cannot be easily removed which prevents damage to the writing instrument 14 (i.e., drying out of the writing tips).

The spring clip 32 and writing instrument 14 can be located in a variety of other positions on the rear cover 18, and can also be located on the front cover 16, cover flap 24 and various other parts of the bound component 10. In addition, the writing instrument 14/retaining component 32 can be located on various other components, as well as clip boards, bulletin boards, white boards, bound components, etc.

In addition, the retaining component 32 need not necessarily take the form of the spring clip shown herein. For example, the retaining component 32 can take the form of corresponding portions of hook-and-loop fastening material (such as VELCRO®), snap components, adhesive material, inter-engaging shapes or the like. In this case, the writing instrument 14 may remain packaged and secured to the rear cover 18 or other component by a flap or the like similar to the bottom portion 44 of the packaging 42.

Having described the invention in detail and by reference to the preferred embodiments, it will be apparent that modifications and variations thereof are possible without departing from the scope of the invention.

What is claimed is:

1. A writing instrument system comprising:

a writing instrument;

packaging generally encasing said writing instrument, said packaging including a package opening formed therein; and a retaining component configured to be releasably coupled to said writing instrument, wherein said retaining component is configured to at least partially extend through said package opening when said writing instrument is releasably coupled to said retaining component;

wherein said writing instrument, when not coupled to said retaining component, remains securely packaged within said packaging and not easily removed from said packaging.

2. The system of claim 1 further including a generally flat and planar backing panel, and wherein said retaining component is located on said backing panel.

3. The system of claim 2 wherein at least part of said packaging is movably coupled to said backing panel.

4. The system of claim 2 wherein at least part of said packaging is rotatably coupled to said backing panel.

5. The system of claim 2 wherein at least part of said packaging is positioned between said backing panel and said retaining component.

6. The writing instrument system of claim 2, wherein a portion of said packaging is trapped between said retaining component and said backing panel.

7. The system of claim 1 wherein said packaging is directly coupled to said retaining component.

8. The system of claim 1 wherein said retaining component is a spring clip.

9. The system of claim 8 wherein said spring clip has a base portion and a pair of arms defining a clip opening therebetween, and wherein said writing instrument is removably receivable in said clip opening.

10. The system of claim 9 wherein said clip opening has a mouth with a width which is smaller than a width of at least part of said writing instrument, and wherein said arms are movable away from each other by exertion of a manual force when said writing instrument is pressed into said mouth such that said writing instrument is manually passable through said mouth into said clip opening.

11. The system of claim 1 wherein said retaining component is a portion of hook-and-loop fastening material, or a snap component or an adhesive material.

12. The system of claim 1 wherein said marking instrument includes a pair of opposed ends, and wherein said packaging generally covers both of said ends.

13. The system of claim 1 wherein at least part of said packaging is generally translucent to allow a user to view said writing instrument though said packaging.

14. The system of claim 1 wherein said marking instrument is a pen, pencil or marker.

15. The system of claim 1 wherein said marking instrument includes an end cap removably located on an end thereof, and wherein said packaging generally prevents a user from removing said end cap.

16. The system of claim 1 further including a backing panel, and wherein said retaining component is located on said backing panel, and wherein said packaging includes a generally flat bottom surface which is configured to lie generally flat against said backing panel when said writing instrument is releasably coupled to said retaining component.

17. The system of claim 16 wherein said package opening is formed in said bottom surface.

18. The system of claim 1 further comprising a bound component including a backing panel and a plurality of pages bound to said backing panel, and wherein said retaining component is coupled to said backing panel.

19. The system of claim 18 wherein when said bound component is viewed in top view said backing panel has a protruding portion that is not covered by said plurality of pages, and wherein said retaining component is located on said protruding portion.

20. The system of claim 18 further comprising a binding mechanism binding said backing panel and said plurality of pages together.

21. A writing instrument system comprising:

a writing instrument having a pair of distal ends;

a spring clip having base portion and a pair of arms defining a clip opening therebetween, said spring clip and said writing instrument being configured such that said writing instrument is releasably receivable in said clip opening to retain said writing instrument therein; and a coupling component coupling said writing instrument and said spring clip, wherein said writing instrument is movable between a coupled position wherein said writing instrument is removably received in said spring clip, and an uncoupled position wherein said writing instrument is not received in said spring clip, wherein said coupling component comprises packaging covering said distal ends in both said coupled position and said uncoupled position, and wherein said coupling component couples said writing instrument and said spring clip when said writing instrument is received in said spring clip and when said writing instrument is not received in said spring clip;

wherein said writing instrument in said uncoupled position remains securely packaged within said packaging and not easily removed from said packaging.

22. The system of claim 21 wherein said coupling component directly or indirectly couples said writing instrument and said spring clip.

23. The system of claim 21 wherein said coupling component is generally flexible such that at least part of said coupling component is bent when said writing instrument is in at least one of said coupled position or said uncoupled position.

24. The system of claim 21 wherein said coupling component includes packaging generally encasing said writing instrument.

25. The system of claim 24 wherein said packaging including a package opening formed therein, and wherein said spring clip extends through said package opening when said writing instrument is releasably coupled to said spring clip.

26. The writing instrument system of claim 21, further comprising a backing panel, wherein said base portion is attached to said backing panel, and wherein a portion of said coupling component is trapped between said base portion and said backing panel.

27. A writing instrument system comprising:

a writing instrument having a pair of distal ends;

packaging generally encasing said writing instrument, said packaging including a package opening formed therein, said package opening being shorter than said writing instrument; and a retaining component configured to be releasably coupled to said writing instrument, wherein said retaining component is configured to at least partially extend through said package opening when said writing instrument is releasably coupled to said retaining component, wherein, when said writing instrument is uncoupled from said retaining component, said writing instrument remains securely packaged within said packaging, said distal ends are covered by said packaging, and a user may feel said writing instrument through said package opening.

28. The writing instrument system of claim 27, further comprising a backing panel, wherein said retaining component is attached to said backing panel, and wherein a portion of said coupling component is trapped between said retaining component and said backing panel.

* * * * *